US006671482B2

(12) United States Patent
DiIanni et al.

(10) Patent No.: US 6,671,482 B2
(45) Date of Patent: Dec. 30, 2003

(54) TONER CARTRIDGE CAP

(75) Inventors: Luigi Gaspare DiIanni, Greensburg, PA (US); Kenneth Michael Myers, Latrobe, PA (US)

(73) Assignee: Raven Industries, Inc.

( * ) Notice: Subject to any disclaimer, the term of this patent is extended or adjusted under 35 U.S.C. 154(b) by 0 days.

(21) Appl. No.: 10/007,077

(22) Filed: Dec. 4, 2001

(65) Prior Publication Data

US 2003/0103782 A1 Jun. 5, 2003

(51) Int. Cl.[7] ..... G03G 15/08

(52) U.S. Cl. ..... 399/262; 222/DIG. 1; 399/120; 399/263

(58) Field of Search ..... 222/DIG. 1; 399/120, 399/258, 260, 262, 263

(56) References Cited

U.S. PATENT DOCUMENTS

| | | | | |
|---|---|---|---|---|
| 1,553,613 A | | 9/1925 | Holthoff | |
| 2,746,632 A | | 5/1956 | Bramming | |
| 2,965,266 A | | 12/1960 | Rutkus, Jr. et al. | |
| 3,382,887 A | | 5/1968 | Erickson | |
| 3,853,246 A | | 12/1974 | Dubois | |
| 3,915,340 A | | 10/1975 | Koeleman | |
| 3,979,026 A | | 9/1976 | Lee | |
| 4,212,264 A | | 7/1980 | Knechtel et al. | |
| 4,611,730 A | | 9/1986 | Ikesue et al. | |
| 4,641,945 A | | 2/1987 | Ikesue et al. | |
| 4,744,493 A | | 5/1988 | Ikesue et al. | |
| 5,455,662 A | | 10/1995 | Ichikawa et al. | |
| 5,765,079 A | * | 6/1998 | Yoshiki et al. | 399/258 |
| 5,774,773 A | | 6/1998 | Otsuka et al. | |
| 5,918,095 A | | 6/1999 | Huang | |
| 5,966,574 A | | 10/1999 | Ui et al. | |
| 5,970,292 A | | 10/1999 | Miller | |
| 5,970,293 A | | 10/1999 | Huang | |
| 6,067,432 A | | 5/2000 | Huang | |

* cited by examiner

*Primary Examiner*—Hoang Ngo
(74) *Attorney, Agent, or Firm*—Jones Day; Robert O. Lindefjeld; John M. McIntyre

(57) ABSTRACT

The present invention provides a toner cartridge cap with a cylindrical base portion with preferably at least one opening in its upper sidewalls and at least one collection fin extending into the toner bottle, the base portion being attached to a standard toner supply cartridge, a cylindrical top portion containing at least one opening in its sidewalls which rotates along a fixed plane inside the base portion, and the top portion being secured to the base portion so as to prevent separation and loss of toner.

19 Claims, 10 Drawing Sheets

TONER CARTRIDGE CAP

BACKGROUND OF THE INVENTION

This invention relates to an improved device for dispensing powder or granulated material for imaging devices such as copiers, facsimile machines, and printers. More particularly, this invention relates to an improved toner cartridge cap that facilitates the conveyance of toner material from a toner cartridge to the developer in an imaging device.

Imaging devices such as photocopiers, facsimile machines, computer printers and the like typically use dry toner particulate material to produce electrostatic latent images. As a result of the continuous dissipation of toner material in this process, the supply of toner to the developer must be rejuvenated on a regular basis. Conventional imaging devices often employ cylindrical containers or cartridges of toner, for example as taught in U.S. Pat. No. 5,774,773. Prior inventions employ a cartridge cap that fits tightly within one end of the toner cartridge, while the outside surface of the cartridge cap extends over the perimeter of the toner cartridge. In these devices, toner is transferred as it is needed to the developer by rotating the toner cartridge, which is typically mounted on its side. As the toner cartridge is rotated in such inventions, a shutter mechanism, which covers a small opening in the cartridge cap, is retracted, allowing toner to flow through the cartridge cap to the developer.

There are certain problems or deficiencies with the design of prior toner cartridge and cartridge cap assemblies. First, prior inventions do not include a method to securely lock the cartridge cap to the toner cartridge. Therefore, an end user can inadvertently dislodge the cartridge cap from the cartridge while removing the cartridge from the imaging device, causing toner to pour out of the cartridge and be lost and dirtying the user and work environment.

Further, prior inventions do not always permit the toner to exit the cartridge at a rate sufficient to ensure proper print quality. Tests have shown that an average of only 0.5 grams of toner can flow through a common cartridge cap per revolution of the toner cartridge when the cartridge contains between approximately 250 and 710 grams of toner. The reduced flow of toner out of the cartridge degrades print quality and/or requires the drive motor which rotates the cartridge to operate more frequently than would otherwise be necessary.

Moreover, prior inventions do not completely prevent the discharge of toner from the cartridge cap once the shutter is moved to the closed position. Because the cartridge cap does not have a sealing mechanism at the point of discharge, toner spills out of the cartridge cap during removal of the toner cartridge. Such spills cause a loss of toner and pollute the machine, the work area, and the user.

Finally, existing designs require two large openings on the tip of the cartridge cap to enable adequate toner flow. These large openings allow dust to escape from the toner cartridge and contaminate the internal mechanisms of the imaging device. The present invention channels the toner through the end of the cartridge more efficiently and prevents the toner from packing around the discharge end of the cartridge. The efficient channeling of the toner through the end of the cartridge then enables the exit holes on the cap to be smaller in size. The reduced size of the exit holes in the configuration of the present invention limits the amount of dusting that might occur in the imaging device while still providing an adequate supply of toner to the developer.

The present invention overcomes the problems and deficiencies of existing toner cartridge and cap assemblies, as described above. It is one object of the present invention to provide a secure means to lock the cartridge cap to the toner cartridge, preventing the end user from inadvertently dislodging the cartridge cap from the cartridge. It is a further object of the present invention to provide a device which can permit toner to flow at a rate sufficient to ensure proper print quality. It is yet another object of the present invention to provide a device which is less likely to discharge toner from the cartridge cap once the cap is moved to the closed position. It is a further object of the invention to provide a device with properly sized openings in the cartridge cap so as to hinder large amounts of dust from escaping from the toner cartridge during normal operations and thereby contaminating the internal mechanisms of the imaging device.

SUMMARY OF THE INVENTION

To achieve the above objects, the present invention provides an improved toner cartridge cap that comprises: a base portion with a cylindrical main body forming a hollow chamber and having a first end and a second end and sidewalls that encircle the diameter of the cylindrical main body and at least one collection fin coupled to the cylindrical main body. Once assembled, the collection fin extends into a toner cartridge and facilitates the conveyance of toner material from the toner cartridge through the first end of the cylindrical main body and into the hollow chamber and into an imaging device. In the preferred embodiment of the present invention, the base portion is coupled to a top portion that is comprised of a top-portion cylindrical main body forming a hollow chamber and having an upper end and a lower end, and sidewalls that encircle the diameter of the top-portion cylindrical main body. Additionally, an end piece is extended in the preferred embodiment across the upper end of the top portion. Preferably, there is at least one opening in the sidewalls of the top portion and at least one opening in the sidewalls of the base portion as well.

The present invention also includes a method for facilitating the conveyance of toner material into an imaging device comprising the steps of employing a base portion with a cylindrical main body forming a hollow chamber and having a first end and second end, coupling the collection fin to the cylindrical main body and extending the collection fin into the toner cartridge. In the preferred embodiment of the present invention, the method further comprises the step of employing a top portion with a top-portion cylindrical main body forming a hollow chamber and having an upper end and a lower end and sidewalls that encircle the diameter of the top-portion cylindrical main body wherein an end piece is extended across the upper end of the top portion. Preferably, the top portion and bottom portion each have at least one opening in their sidewalls to facilitate the conveyance of toner.

DETAILED DESCRIPTION OF THE PREFERRED EMBODIMENT

Figure 1:
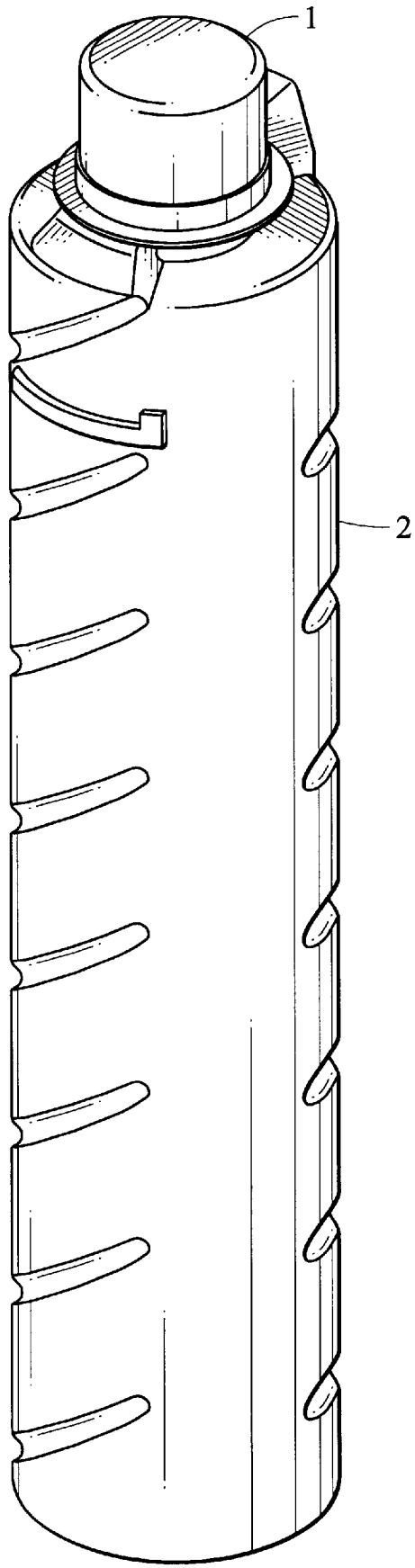
FIG. 1 is a side view depicting the end cap 1 associated with the preferred embodiment of the present invention secured to a representative toner cartridge 2.

FIG. 1 is a side view of an end cap 1 covering the present invention (not shown) secured to a toner cartridge 2 in the manner in which it would typically be stored during periods of non-use. The toner cartridge 2 illustrated in FIG. 1 is intended to be representative of one type of toner cartridge used in imaging devices, but the present invention is not necessarily limited to use in toner cartridges of this particular type. The end cap 1 used for storage preferably has a cylindrical main body forming a hollow chamber with one end of the end cap 1 closed to prevent damage to the present invention during storage periods. In a less preferred embodiment, the end cap 1 may be an open cylinder, thus protecting and concealing only the sides of the present invention. In yet another embodiment, although less preferred, the present invention may be stored without the end cap 1 during periods of non-use. If the end cap 1 is employed, it should preferably be of a dimension such that the inside diameter of the hollow chamber in end cap 1 fits snuggly over the outside of top portion 3, sealing washer 4, sealing pads 5 and 6, and base portion 7, depicted in FIG. 2.

Figure 2:
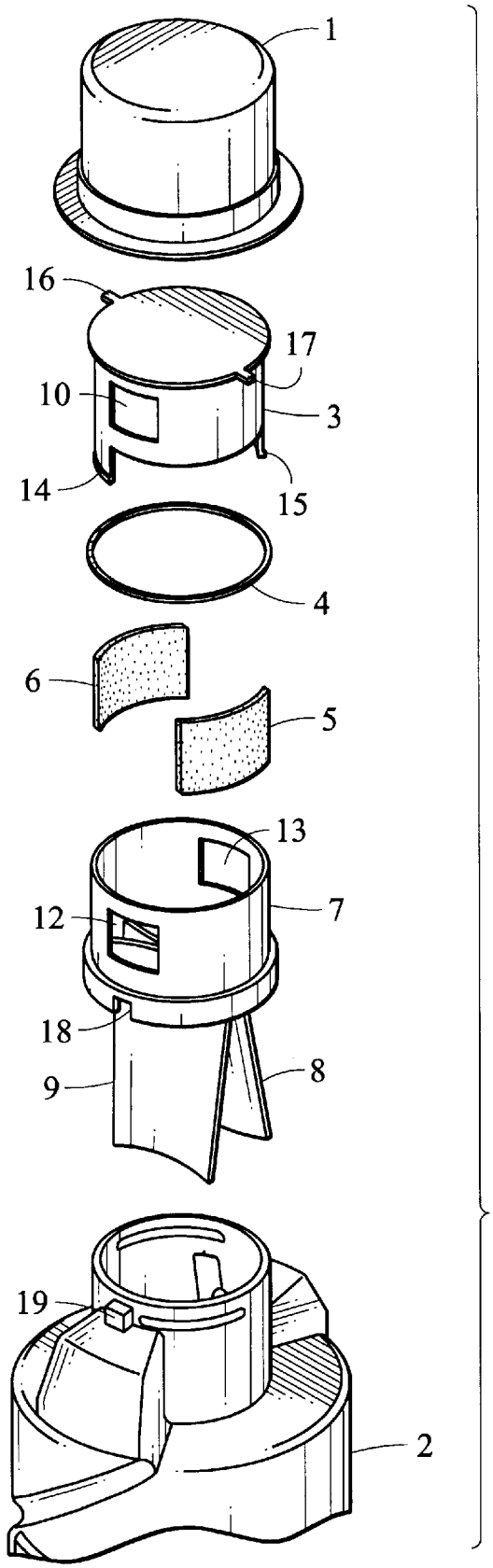
FIG. 2 is an exploded view of the present invention along with the end cap 1 and the upper portion of a representative toner cartridge 2.

Referring to FIG. 2, an exploded view of the preferred embodiment of the invention is depicted along with the end cap 1 and the upper section of a toner cartridge 2. Like the end cap 1, the top portion 3 has a cylindrical main body forming a hollow chamber having sidewalls that encircle the diameter of the cylindrical main body and a preferably flat planar surface or end piece covering one end of the cylindrical main body. The planar surface of the top portion 3 preferably extends over the sidewalls of the cylindrical main body of the top portion 3 and, in the preferred embodiment, includes two ears 16 and 17 to couple to attachments common in existing imaging devices.

Like the top portion 3, the base portion 7 also has a cylindrical main body forming a hollow chamber having sidewalls that encircle the diameter of the cylindrical main body, but is open on both ends to enable toner to flow through the base portion 7. The base portion 7 also preferably includes a lip that attaches to and extends around the outer sidewalls of the bottom of the base portion 7.

In the preferred embodiment, both the top portion 3 and base portion 7 include openings in their sidewalls, openings 10, 11 (depicted in FIGS. 3, 4, and 7), 12, and 13, to enable the flow of toner to be turned on or off, as described more fully below. Alternatively, the top portion 3 and base portion 7 could include any number of openings in their sidewalls.

In the preferred embodiment, a sealing washer 4 is affixed near the top of the outer sidewalls of the top portion 3 just below the two ears 16 and 17. The purpose of the sealing washer 4 is to prevent leakage of toner material out of the seam created when the top portion 3 is inserted into the base portion 7. Similarly, in the preferred embodiment, two sealing pads 5 and 6 are affixed to the outer sidewalls of the top portion 3 such that the openings 10 and 11 in the sidewalls of the top portion 3 are not obstructed by the sealing pads 5 and 6. The purpose of the sealing pads 5 and 6 is to create a seal around openings 12 and 13 to prevent spillage of toner material during periods of storage. Although two sealing pads 5 and 6 are depicted in the preferred embodiment described herein, any number of sealing pads could be affixed to the outer sidewalls of the top portion 3 so long as the openings in the sidewalls of the top portion 3 remain unobstructed.

In the preferred embodiment, the inside diameter of the hollow chamber formed by the cylindrical main body of end cap 1 slightly exceeds the outside diameter of the base portion 7 and the distance between the outer ends of the ears 16 and 17. Similarly, the inside diameter of the base portion 7 slightly exceeds the outer diameter of the sidewalls of the top portion 3, such that the sealing pads 5 and 6 affixed to the sidewalls of the top portion 3 fit snuggly inside the upper section of the base portion 7.

One less preferred embodiment of the invention exists wherein the top portion 3 fits snuggly over the base portion 7, i.e., the inside diameter of the top portion 3 slightly exceeds the outer diameter of the base portion 7. In this configuration, the base portion 7 is inserted into the top portion 3. In the less preferred embodiment, one or more sealing pads are affixed to the inner sidewalls of top portion 3 or the outer sidewalls of the base portion 7.

In the preferred embodiment, the cylindrical main body of the top portion 3 includes locking tabs 14 and 15. Once the invention is assembled, the locking tabs 14 and 15 engage the lower edge of the hollow chamber formed by the base portion 7 while still allowing top portion 3 to rotate relative to the base portion 7. If desired, the base portion 7 may be separated from the top portion 3 by applying an inward and upward pressure to the bottom of the locking tabs 14 and 15 towards the center of the hollow chamber of the base portion 7 while holding the outside of the base portion 7 fixed. In a less preferred embodiment, the top portion 3 could include any number of locking tabs to engage with the hollow chamber of the base portion 7. In yet another less preferred embodiment, the base portion 7 could include any number of locking tabs to engage the top portion 3. The locking tabs 14 and 15 reflected in FIG. 2 are merely illustrative of a number of different ways of enabling the top portion 3 to be secured to the base portion 7 while still allowing the top portion 3 to rotate relative to the base portion 7. For example, in another less preferred embodiment, the inner sidewalls of the base portion could include a ridge or groove designed to engage a groove or ridge in the outer sidewalls of the top portion. In still another less preferred embodiment, in the configuration where the top portion 3 fits snuggly over the base portion 7, i.e., the inside diameter of the top portion 3 slightly exceeds the outer diameter of the base portion 7, the outer sidewalls of the base portion could include a ridge or groove designed to engage a groove or ridge in the inner sidewalls of the top portion.

In the preferred embodiment, the cylindrical main body of the base portion 7 is coupled to collection fins 8 and 9, which extend outward from one end of the cylindrical main body of the base portion 7 and into the toner cartridge 2 for the purpose of facilitating the conveyance of toner material from the toner cartridge 2 to the cylindrical main body of the base portion 7 and into the hollow chamber formed thereby. It is important to note that the collection fins 8 and 9 may be of any number, size, or shape, so long as they facilitate the conveyance of toner material into the hollow chamber formed by the cylindrical main body of the base portion 7. For example, there could be a single collection fin with concave planar surfaces on either side of the fin or it could be formed in the shape of a cork-screw to continuously replenish toner material from the toner cartridge 2 into the hollow chamber formed by the cylindrical main body of the base portion 7 during periods of use. This cork-screw shaped collection fin may either be a twisted flat or concave planar surface or a twisted hollow tube. The end cap 1, top portion 3, and base portion 7 are each preferably plastic to keep production costs at a minimum, although any durable hard material, such as metal, would be acceptable.

In the preferred embodiment, the base portion 7 is attached to a toner cartridge 2 by applying an inward force to the neck of the toner cartridge 2 and sliding the lower lip of the base portion 7 over the outside of the neck of the toner cartridge 2. In this configuration, the neck of the toner cartridge 2 will exert a constant force against the lip of the base portion 7, thereby securing the base portion 7 to the toner cartridge 2. During operation in the imaging device, the base portion 7 is preferably held fixed to the toner cartridge 2. This is accomplished in the preferred embodiment through the use of least one notch 18 in the bottom of the lower lip of the base portion 7. The notch 18 in the lower lip of the base portion 7 couples to an outcropping 19 on the outside of the toner cartridge 2, allowing the toner cartridge 2 and base portion 7 to lock together and rotate as one. Once the base portion 7 is attached to the toner cartridge, the fins 8 and 9 extend into the toner cartridge 2 to collect toner material as the toner cartridge 2 is rotated.

A less preferred embodiment incorporates L-shaped protrusions on the neck of the toner cartridge 2 and spiral grooves inside the lip of the base portion 7. The base portion 7 is secured to the toner cartridge 2 in this less preferred embodiment by rotating the base portion 7 in a clockwise or counter-clockwise direction (depending on the orientation of the spiral grooves), thereby engaging the L-shaped protrusions in the neck of the toner cartridge 2 in the spiral grooves in the base portion 7, much like screwing a nut onto a bolt. Another less preferred embodiment incorporates L-shaped protrusions inside the lip of the base portion 7 and spiral grooves on the neck of the toner cartridge 2. The base portion 7 is secured to the toner cartridge 2 in this less preferred embodiment by rotating the base portion 7 in a clockwise or counter-clockwise direction (depending on the orientation of the spiral grooves), thereby engaging the L-shaped protrusions in the base portion 7 in the spiral grooves of the neck of the toner cartridge 2, much like screwing a bolt into a nut. In yet another embodiment of the present invention, the base portion 7 is simply glued to the toner cartridge 2 to ensure that the base portion 7 does not separate from or move relative to the toner cartridge 2.

Operation of the assembled invention is accomplished by first separating the end cap 1 from the present invention by preferably holding the lip of the base portion 7 fixed while applying a force to the end cap 1 away from the toner cartridge 2.

Figure 3:
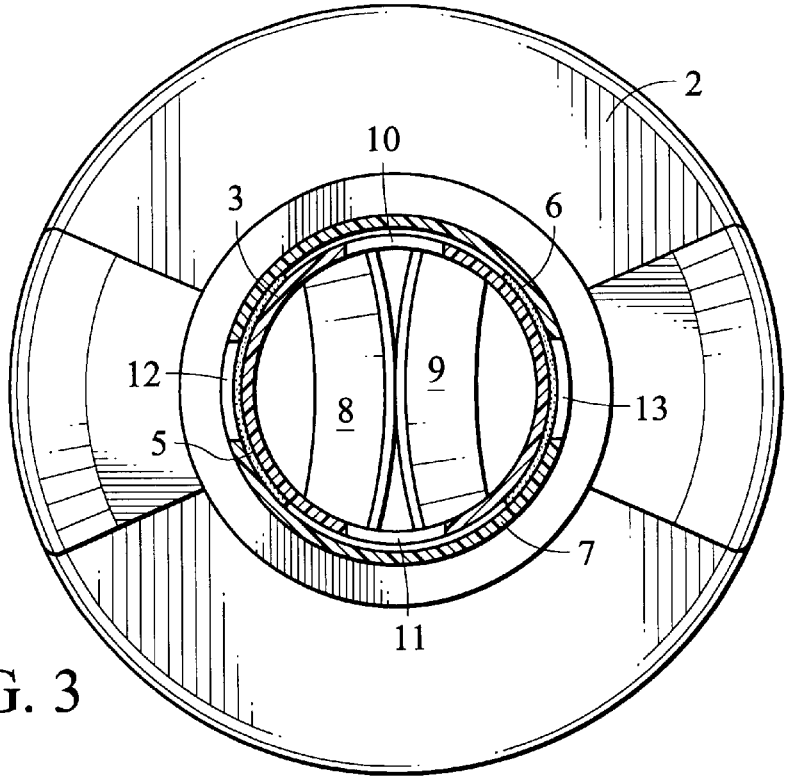
FIGS. 3 and 4 are alternative cross-section top views of the present invention attached to a representative toner cartridge 2 with the end cap 1 removed.

FIG. 3 is a schematic illustration showing a cross-section top view of the preferred embodiment of present invention attached to a toner cartridge 2 where the openings 10 and 11 in the sidewalls of the top portion 3 are not aligned with openings 12 and 13 in the base portion 7. In this closed configuration, no toner will flow through the openings 10, 11, 12, and 13 and sealing pads 5 and 6 form a seal around openings 12 and 13 to ensure that toner does not leak out. The invention would preferably be stored in this closed configuration to prevent spillage of toner during periods of non-use.

In the preferred embodiment, toner flow is enabled by coupling the ears 16 and 17 (see FIGS. 2, 5, and 6) to attachments in the imaging device to temporarily hold the top portion 3 fixed while the base portion 7 and toner cartridge 2 are collectively rotated by hand by the operator. In the preferred embodiment, once the invention is assembled in the closed position, the base portion 7 may only be rotated relative to the top portion 3 in a clockwise direction and only until the locking tabs 14 and 15 come into contact with the collection fins 8 and 9. Once the base portion 7 is fully rotated in the clockwise direction relative to the top portion 3 and the locking tabs 14 and 15 come into contact with the collection fins 8 and 9, the invention is in the open position and the openings 10 and 11 in the sidewalls of the top portion 3 will be fully aligned with openings 12 and 13 in the base portion 7, enabling maximum toner flow.

Figure 4:
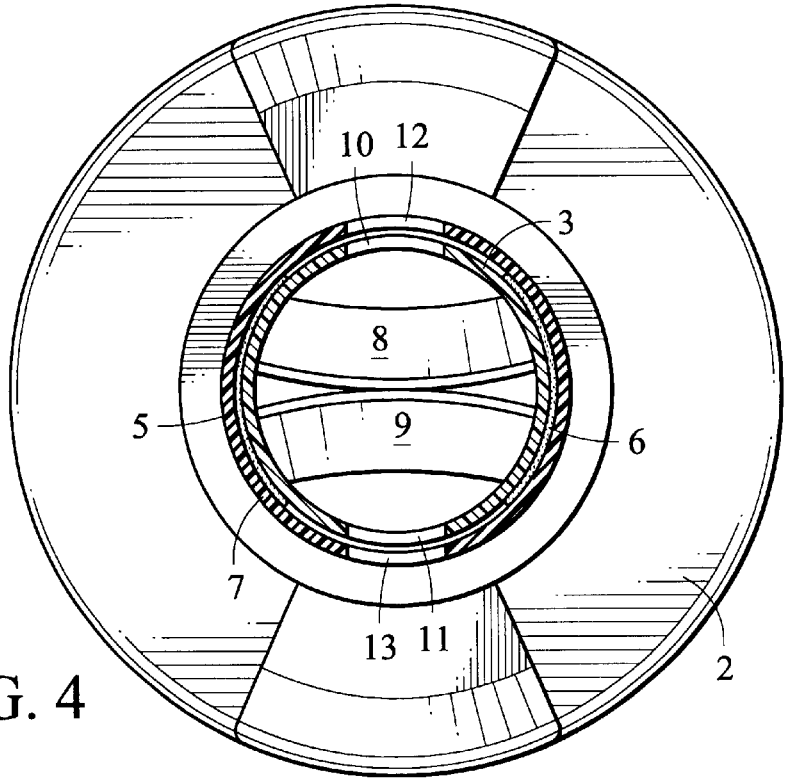

FIG. 4 is a schematic illustration showing a cross-section top view of the preferred embodiment of the present invention in the open position attached to a toner cartridge 2 where the openings 10 and 11 in the sidewalls of the top portion 3 are fully aligned with openings 12 and 13 in the base portion 7, enabling maximum toner flow. Once the openings 10 and 11 in the sidewalls of the top portion 3 are fully aligned with openings 12 and 13 in the base portion 7, the toner cartridge 2, base portion 7, and top portion 3 will all rotate as one while the imaging device is in operation. If the toner cartridge 2 and attached invention are rotated, as is customary in imaging devices, gravity will force toner from the cartridge 2 into the concave fins 8 and 9, as reflected by the concentration of toner particles in FIGS. 8 and 9. Because the fins 8 and 9 are preferably angled in towards the center of the base portion 7 and the top portion 3, gravity will pull toner collecting in the fins 8 and 9 toward the center of the base portion 7 and the top portion 3.

In a less preferred embodiment, the top portion 3 may be rotated while the base portion 7 and toner cartridge 2 are held fixed to align the openings 10, 11, 12, and 13. It is important to note that, although the embodiment disclosed herein utilizes ears 16 and 17 to couple the top portion 3 to the imaging device, the invention could also employ alternative methods to achieve a similar purpose, such as an impression set in the center of the top portion 3 that could be engaged by a complementary shaped protrusion extending from the imaging device. Similarly, another embodiment exists wherein an impression is set in the imaging device which could be engaged by a complementary shaped protrusion extending from the top portion 3 to achieve a similar purpose.

In another less preferred embodiment, the openings 10 and 11 in the sidewalls of the top portion 3 may be placed such that, once the invention is assembled in the closed position, the base portion 7 may only be rotated relative to the top portion 3 in the counter-clockwise direction. In this less preferred embodiment, once the base portion 7 is rotated in the counter-clockwise direction relative to the top portion 3 and the locking tabs 14 and 15 come into contact with the collection fins 8 and 9, the openings 10 and 11 in the sidewalls of the top portion 3 will be aligned with openings 12 and 13 in the base portion 7, enabling toner flow.

Figure 5:
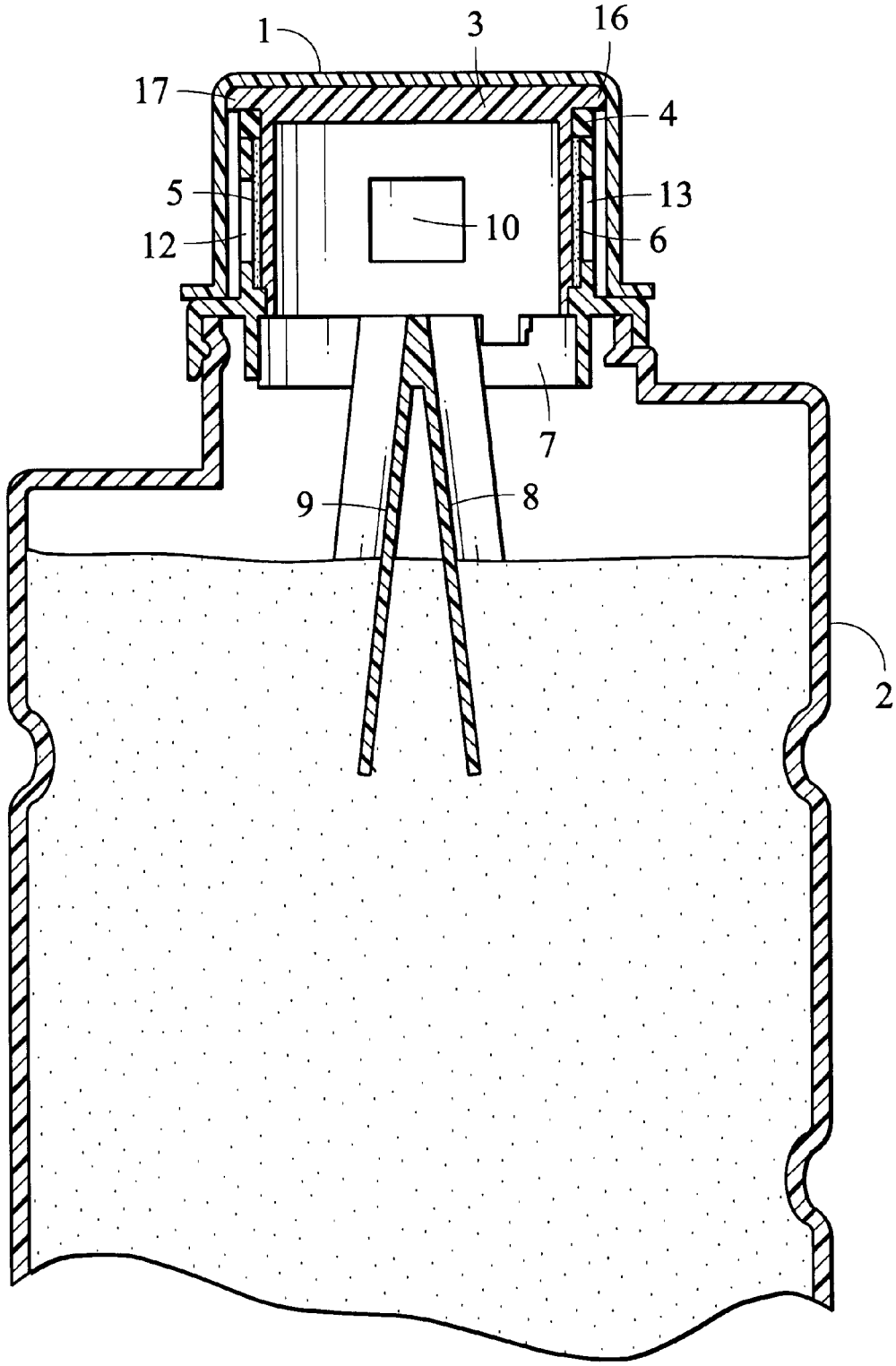
FIGS. 5, 6 and 7 are alternative cross-section side views of the present invention upright.

FIG. 5 is a cross-section side view of the preferred embodiment of the present invention and end cap 1 attached to a toner cartridge 2 in the upright position with the base portion 7 and top portion 3 positioned such that the openings 10 and 11 in the sidewalls of the top portion 3 are not aligned with openings 12 and 13 in the base portion 7. In FIG. 5, fins 8 and 9 extend into the toner cartridge 2 and are in contact with the contained toner, although no toner will flow through openings 12 and 13 because of their nonalignment with openings 10 and 11 and the seal formed by sealing pads 5 and 6 around openings 12 and 13. In this position, the ears 16 and 17 are preferably parallel to and extend out over the openings 12 and 13 in the base portion 7.

Figure 6:
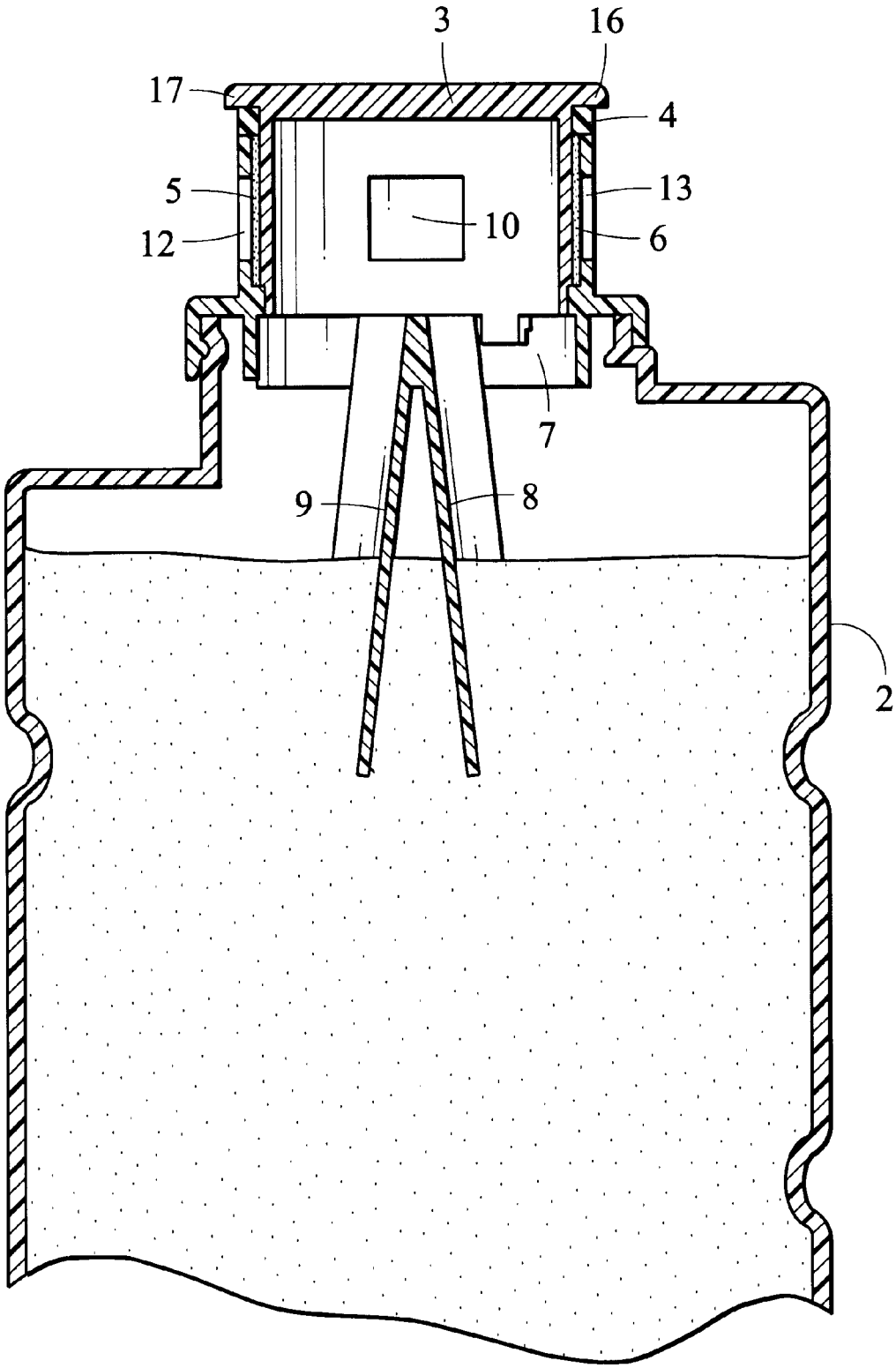

FIG. 6 is similar to FIG. 5 except that the end cap 1 has been removed.

Figure 7:
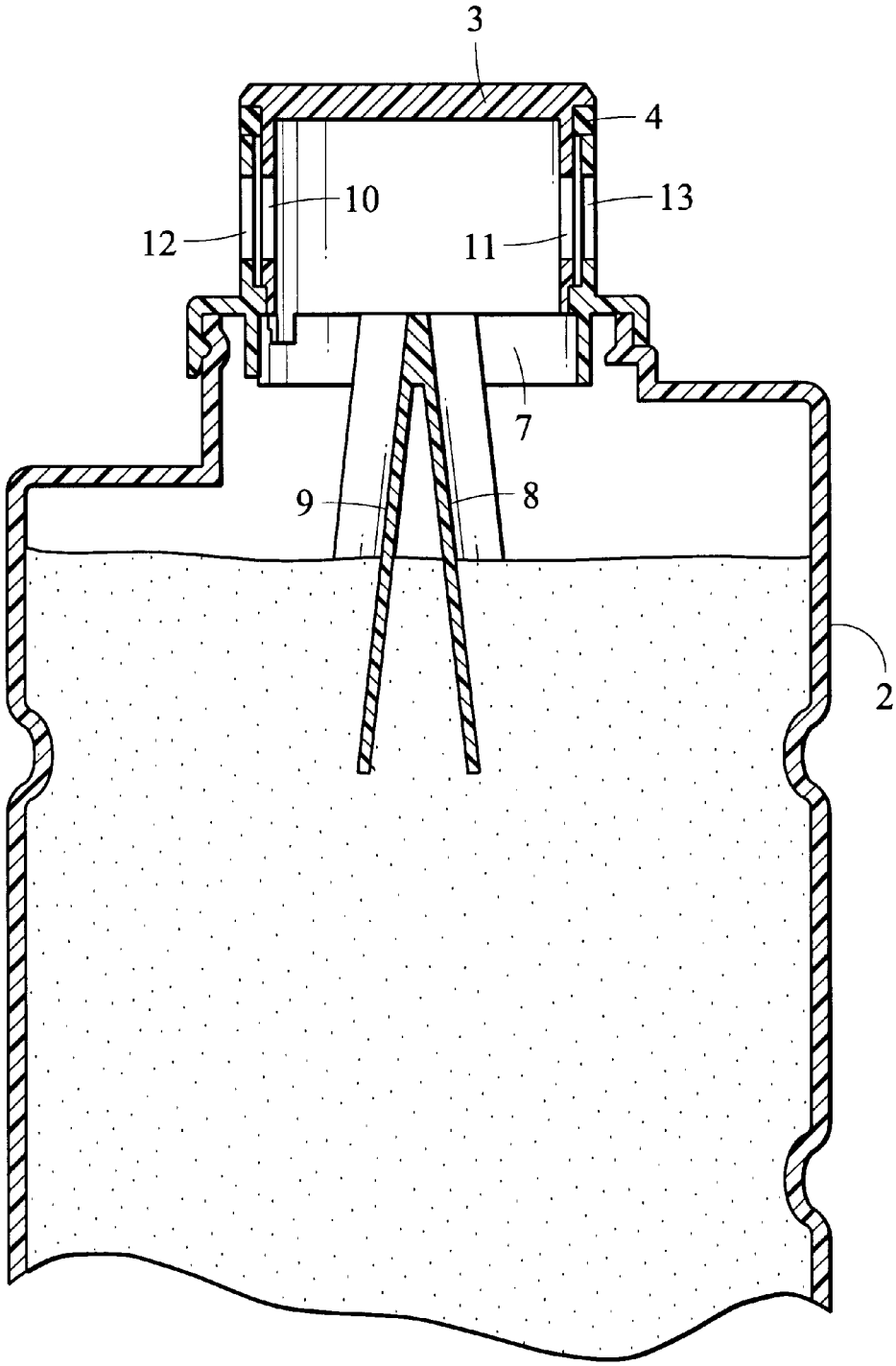

FIG. 7 is a cross-section side view of the preferred embodiment of the present invention attached to a toner cartridge 2 with the base portion 7 and top portion 3 positioned such that the openings 10 and 11 in the sidewalls of the top portion 3 are aligned with openings 12 and 13 in the base portion 7 enabling the flow of toner through openings 10, 11, 12, and 13. In this position, the ears 16 and 17 are preferably perpendicular to the openings 12 and 13 in the base portion 7.

Figure 8:
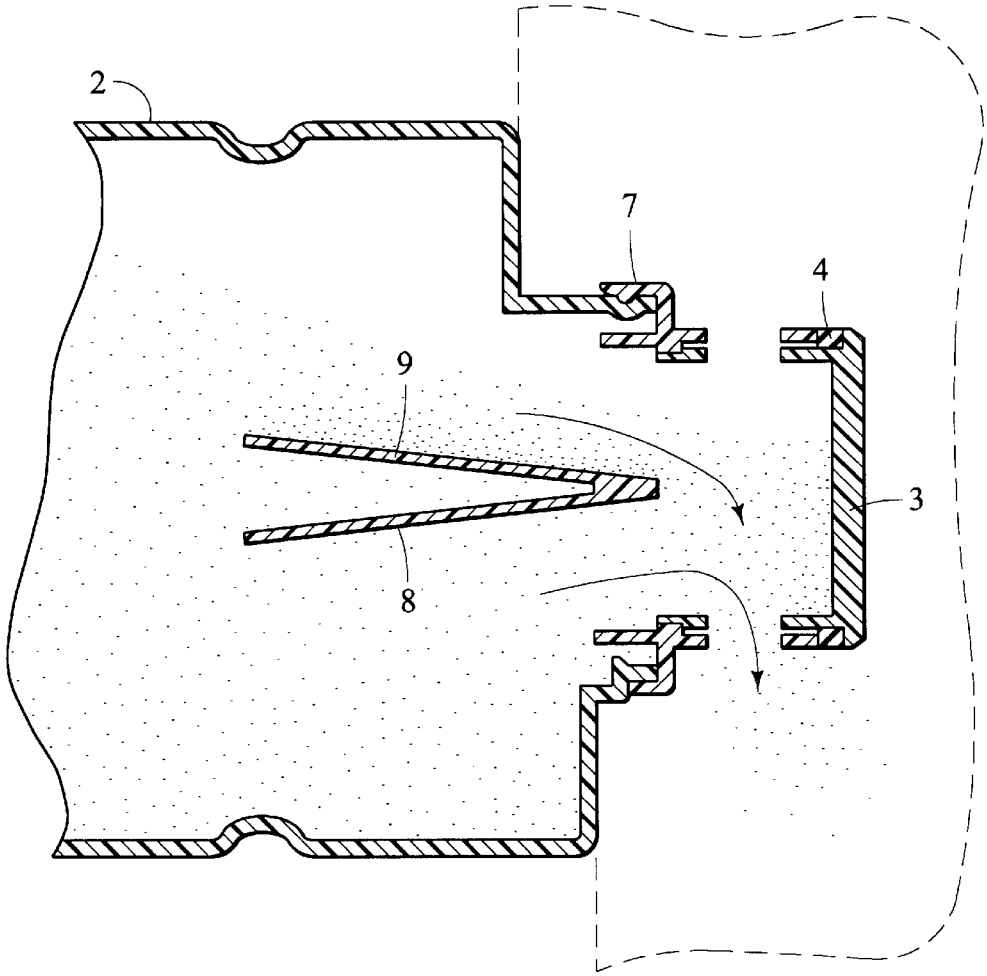
FIGS. 8 and 9 are alternative cross-section side views of the present invention on its side depicting how toner material may be dispensed from a representative toner cartridge.

FIG. 8 is another cross section side view of the preferred embodiment of the present invention and the toner cartridge 2 rotated on their sides so as to illustrate toner flow through the invention and into an imaging device (not shown). In FIG. 8, toner particles collect in fin 9 and are channeled through opening 11 in the top portion 3 and opening 13 in the base portion 7.

Figure 9:
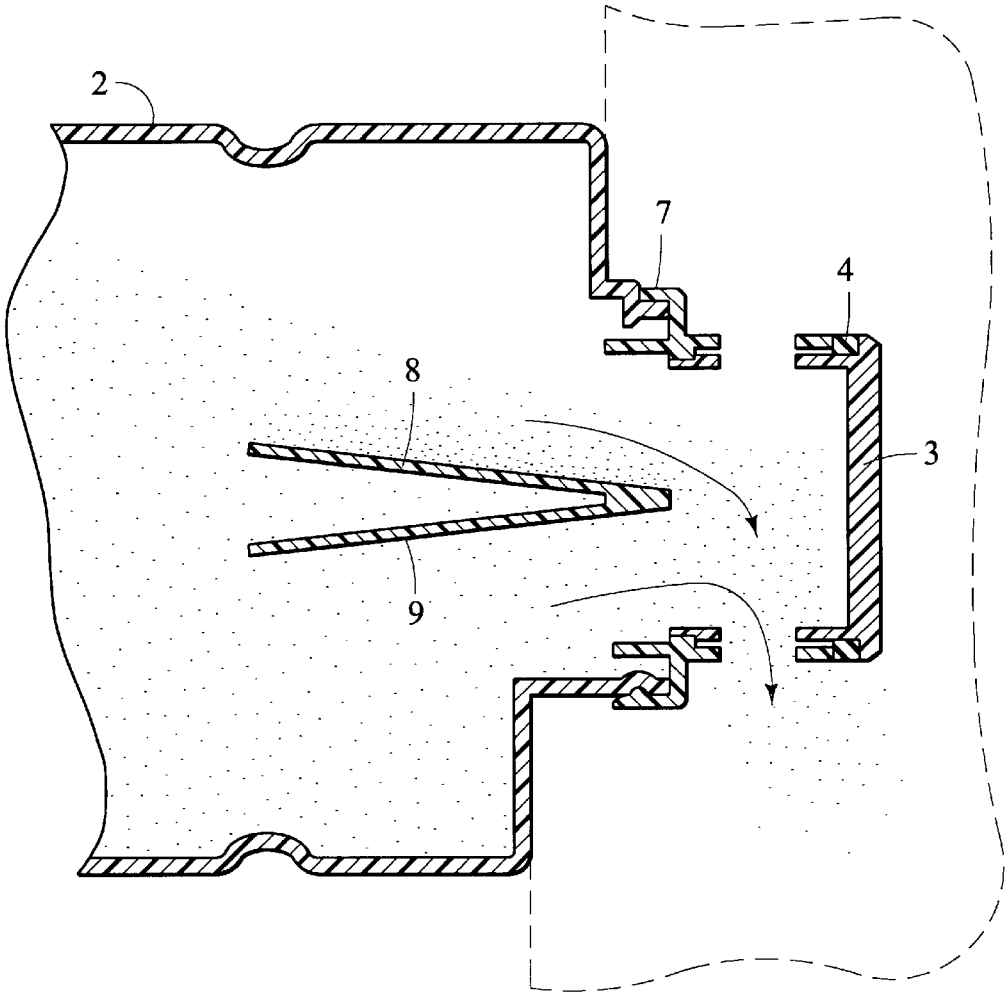

FIG. 9 is similar to FIG. 8 except that the toner cartridge 2 and the present invention have been collectively rotated 180 degrees from the configuration of FIG. 8. Consequently, in FIG. 9, toner particles collect in fin 8 and are channeled through the opening 10 in the top portion 3 and opening 12 in the base portion 7.

EXAMPLES

The following examples further demonstrate the present invention and its benefits. These examples should not, however, be construed as limiting the present invention in any way.

Example 1

Figure 10:
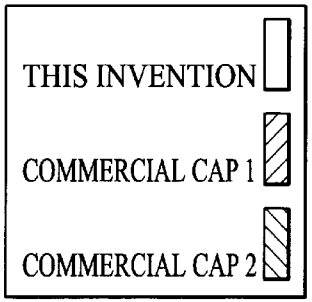
FIG. 10 is a legend which identifies the cartridge caps used to obtain the results reported in FIGS. 11 and 12.

To test the effectiveness of the disclosed present invention, laboratory tests were conducted that measured the flow of toner through toner cartridge caps of various designs, including the present invention. This initial test was performed with a toner having a relatively low flow rate and having a bulk density of 0.33 grams per cubic centimeter. A toner cartridge attached to the present invention was filled with 710 grams of toner. Two other commercially available toner cartridge and cap assemblies, Commercial Cap 1 and Commercial Cap 2, were also prepared in the same manner with an identical amount of the same toner for comparison testing. All three samples were loaded, in succession, into an apparatus designed to simulate the rotation of a toner cartridge and cartridge cap assembly in a typical imaging device. The three samples were each initially given three 360-degree rotations and the amount of toner flowing through the cartridge caps was collected and weighed and then divided by three to give the average flow per 360-degree rotation. In subsequent tests, samples were each given four 360-degree rotations and the amount of toner flowing through the cartridge caps was collected and weighed and then divided by four to give the average flow per 360-degree rotation. The three samples were repeatedly rotated without adding more toner and the toner flowing through the cartridge caps was collected and weighed after every four, 360-degree rotations. The results of these laboratory tests are reported in FIGS. 10 and 11. FIG. 10 is a legend which identifies the cartridge caps used to obtain the results reported in FIGS. 11 and 12. The present invention in FIG. 10 is designated as "This Invention."

Figure 11:
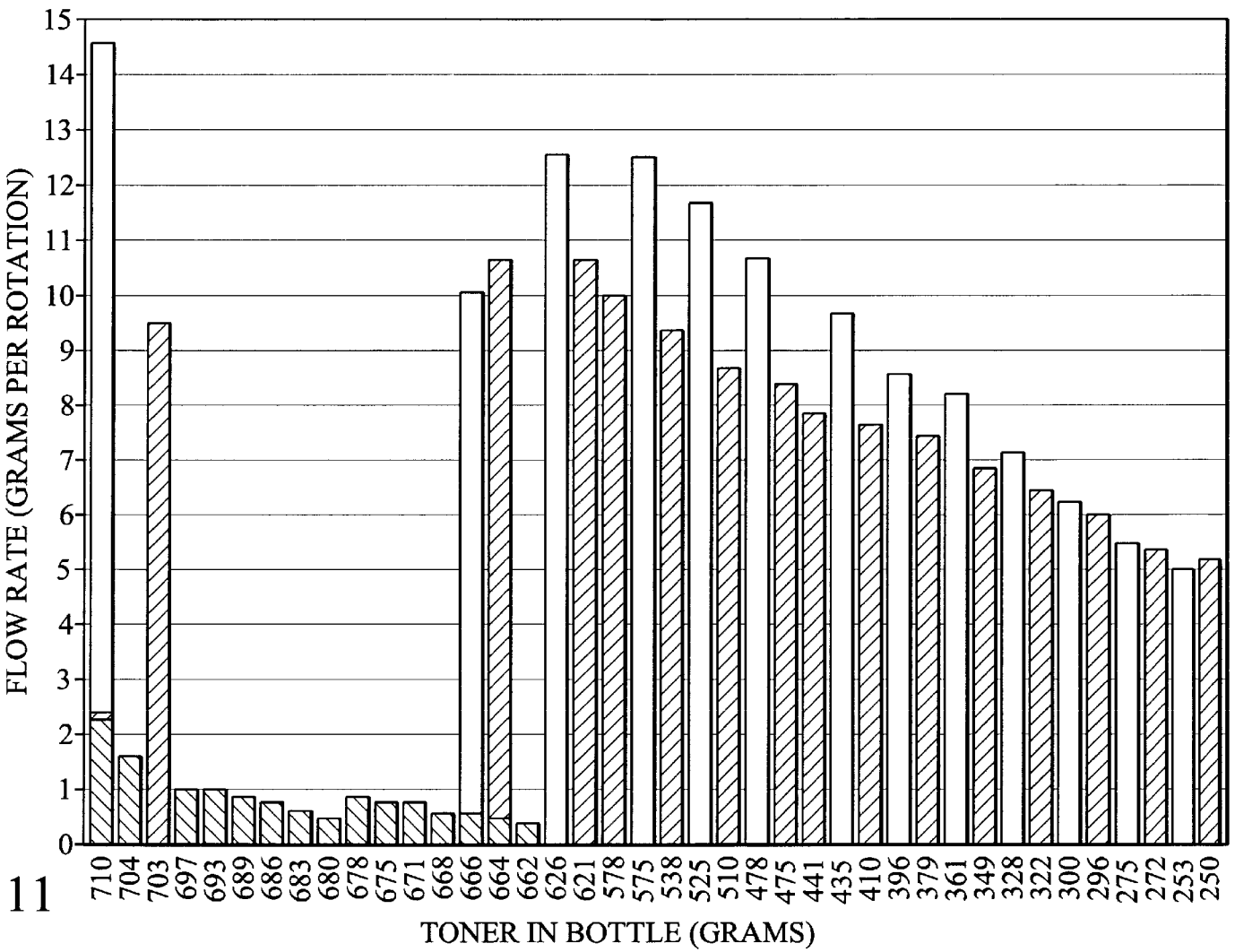
FIG. 11 is a graphical illustration of the results of laboratory tests that measured the flow of toner through toner cartridge caps of various designs, including the present invention.

As illustrated in FIG. 11, the levels of toner flowing from the toner cartridge through the present invention were greater than those that flowed through the Commercial Cap 1 when the cartridge contained more than 300 grams of toner in the cartridge. Further, the levels of toner flowing from the toner cartridge through the present invention were consistently greater than those that flowed through the Commercial Cap 2 under all conditions.

Example 2

A second set of laboratory tests were conducted to study the performance of the present invention with a toner that has a relatively high flow rate and a bulk density of 0.35 grams per cubic centimeter. A toner cartridge equipped with the present invention was filled with 710 grams of toner. Two other commercially available toner cartridge and cap assemblies, Commercial Cap 1 and Commercial Cap 2, were also prepared in the same manner, each with an identical amount of the same toner for comparison testing. All three samples were loaded, in succession, into an apparatus designed to simulate the rotation of a toner cartridge and cartridge cap assembly in a typical imaging device. The three samples were each initially given three 360-degree rotations and the amount of toner flowing through the cartridge caps was collected and weighed and then divided by three to give the average flow per 360-degree rotation. In subsequent tests, samples were each given four 360-degree rotations and the amount of toner flowing through the cartridge caps was collected and weighed and then divided by four to give the average flow per 360-degree rotation. The three samples were repeatedly rotated without adding more toner and the toner flowing through the cartridge caps was collected and weighed after every four, 360-degree rotations. The results of these laboratory tests are reported in FIG. 12.

Figure 12:
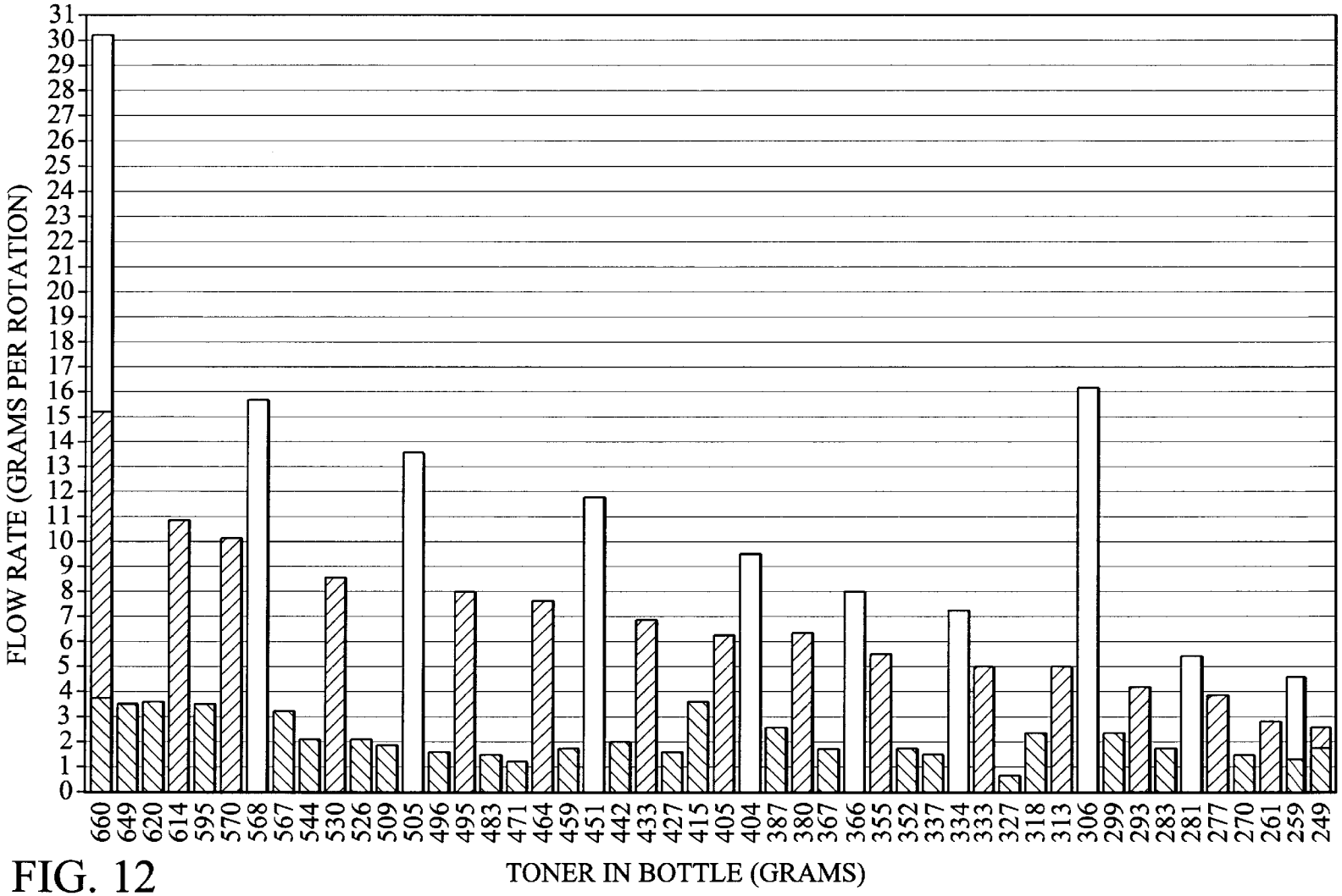
FIG. 12 is also a graphical illustration of the results of laboratory tests that measured the flow of toner through toner cartridge caps of various designs, including the present invention.

As shown in FIG. 12, the levels of high flow-rate toner flowing from the toner cartridge through the present invention were likewise consistently greater than those that flowed through both Commercial Cap 1 and Commercial Cap 2.

Although the present invention has been described in considerable detail with reference to certain preferred versions thereof, other versions are possible. The above description is for the purpose of teaching the person of ordinary skill in the art how to practice the present invention, and it is not intended to detail all obvious modifications and variations that will become apparent to the skilled worker upon reading the description. It is intended, however, that all such modifications and variations be included within the scope of the present invention which is defined by the following claims. Accordingly, the spirit and scope of the appended claims should not be limited to the description of the preferred versions contained herein.

What is claimed is:

1. An improved toner cartridge cap, comprising:

a base portion with a cylindrical main body forming a hollow chamber and having a first end and a second end and sidewalls that encircle the diameter of said cylindrical main body; and at least one collection fin coupled to said cylindrical main body, said at least one collection fin extending into a toner cartridge and facilitating the conveyance of toner material from said toner cartridge through said first end of said cylindrical main body and into said hollow chamber and into an imaging device, wherein said at least one collection fin is not flexible in a circumferential direction of said cylindrical main body and wherein said at least one collection fin is substantially not in contact with said sidewalls that encircle the diameter of said cylindrical main body.

2. The toner cartridge cap of claim 1, wherein said at least one collection fin has a concave-shaped planer surface.

3. The toner cartridge cap of claim 1, wherein said at least one collection fin has a cork-screw shape to continuously replenish said toner material from said toner cartridge through said first end and into said hollow chamber during periods of use.

4. The toner cartridge cap of claim 1, wherein said at least one collection fin is angled in towards the center axis of said cylindrical main body of said base portion.

5. The toner cartridge cap of claim 1, further comprising:

a top portion with a top-portion cylindrical main body forming a hollow chamber and having an upper end and a lower end, and sidewalls that encircle the diameter of said top-portion cylindrical main body;

an end piece extending across said upper end of said top portion;

at least one opening in said sidewalls of said top portion; and at least one opening in said sidewalls of said base portion.

6. The toner cartridge cap of claim 5, wherein said at least one collection fin has a concave-shaped planer surface.

7. The toner cartridge cap of claim 5, wherein said at least one collection fin has a cork-screw shape to continuously replenish said toner material from said toner cartridge through said first end and into said hollow chamber during periods of use.

8. The toner cartridge cap according to claim 5, further comprising at least one locking tab extending from said lower end of said top portion for engaging in said sidewalls of said base portion to ensure that said top portion does not separate from said base portion.

9. The toner cartridge cap according to claim 5, wherein said base portion and said top portion are comprised of plastic.

10. A method for facilitating the conveyance of toner material from a toner cartridge into an imaging device, comprising the steps of:

employing a base portion with a cylindrical main body forming a hollow chamber and having a first end and a second end;

coupling at least one collection fin to said cylindrical main body; and extending said at least one collection fin into toner cartridge, said at least one collection fin not being flexible in a circumferential direction of said cylindrical main body and substantially not in contact with sidewalls that encircle the diameter of said cylindrical main body.

11. The method of claim 10, wherein said at least one collection fin has a concave-shaped planar surface.

12. The method of claim 10, wherein said at least one collection fin has a cork-screw shape to continuously replenish said toner material from said toner cartridge through said first end and into said hollow chamber during periods of use.

13. The method of claim 10, wherein said at least one collection fin is angled in towards the center axis of said cylindrical main body of said base portion.

14. The method of claim 10, further comprising the step of:

employing a top portion with a top-portion cylindrical main body forming a hollow chamber and having an upper end and a lower end and sidewalls that encircle the diameter of said top-portion cylindrical main body, wherein an end piece is extended across said upper end of said top portion and wherein said sidewalls of said top portion have at least one opening and wherein said sidewalls of said base portion have at least one opening.

15. The method of claim 14, wherein said at least one collection fin has a concave-shaped planar surface.

16. The method of claim 14, wherein said at least one collection fin has a cork-screw shape to continuously replenish said toner material from said toner cartridge through said first end and into said hollow chamber during periods of use.

17. The method of claim 14, further comprising the step of employing at least one locking tab that extends from said lower end of said top portion and engages said at least one locking tab in said sidewalls of said base portion to ensure that said top portion does not separate from said base portion.

18. The method of claim 14, wherein said base portion and said top portion are comprised of plastic.

19. An improved toner cartridge cap, comprising:

a top portion;

a base portion, wherein said base portion is coupled to at least one collection fin, said at least one collection fin extending into a toner cartridge and facilitating the conveyance of toner material from said toner cartridge through said base portion and into an imaging device, and wherein said at least one collection fin is not flexible in a circumferential direction of said cylindrical main body and is substantially not in contact with sidewalls that encircle the diameter of said cylindrical main body; and means for securing said top portion to said base portion.

* * * * *